United States Patent [19]

Junghans

[11] Patent Number: 4,546,701

[45] Date of Patent: Oct. 15, 1985

[54] INKING UNIT FOR PRINTING PRESSES

[75] Inventor: Rudi Junghans, Wilhelmsfeld, Fed. Rep. of Germany

[73] Assignee: Heidelberger Druckmaschinen AG, Heidelberg, Fed. Rep. of Germany

[21] Appl. No.: 662,241

[22] Filed: Oct. 18, 1984

[30] Foreign Application Priority Data

Oct. 19, 1983 [DE] Fed. Rep. of Germany ... 8330123[U]

[51] Int. Cl.[4] ..... B41F 31/14; B41L 27/16

[52] U.S. Cl. ..... 101/349; 101/DIG. 14

[58] Field of Search ..... 101/348, 349, 350, DIG. 14, 101/148, 351, 352, 207-210

[56] References Cited

U.S. PATENT DOCUMENTS

| | | | |
|---|---|---|---|
| 1,027,384 | 5/1912 | Green | 101/DIG. 14 |
| 1,533,062 | 4/1925 | Paane | 101/DIG. 14 |
| 3,625,148 | 12/1971 | Muselik | 101/DIG. 14 |

FOREIGN PATENT DOCUMENTS

| | | | |
|---|---|---|---|
| 2078172 | 1/1982 | United Kingdom | 101/DIG. 14 |

*Primary Examiner*—J. Reed Fisher

*Attorney, Agent, or Firm*—Herbert L. Lerner; Laurence A. Greenberg

[57] ABSTRACT

An inking unit for printing machines wherein ink is fed in a metered fashion from an ink supply tank to inking rollers of the inking unit by which an ink film is applicable to a printing plate via a plurality of ink form rollers respectively in contact with a distributor roller and disengageable from a plate cylinder, the last of the plurality of form rollers, as viewed in rotational direction of the plate cylinder, being constructed so as to oscillate, including a roller shaft mounted so as to be fixed against rotation in bearings on the printing machine, the oscillating form roller having a casing with an outer cylindrical surface, the form roller casing being rotatably mounted on the roller shaft and being axially displaceable on the roller shaft for performing a stroke limited at both sides by respective pairs of bushings also mounted on the roller shaft, and including a respective compression spring disposed between the bushings of the respective pairs of bushings on each side of the oscillating form roller.

2 Claims, 2 Drawing Figures

INKING UNIT FOR PRINTING PRESSES

Figure 1:
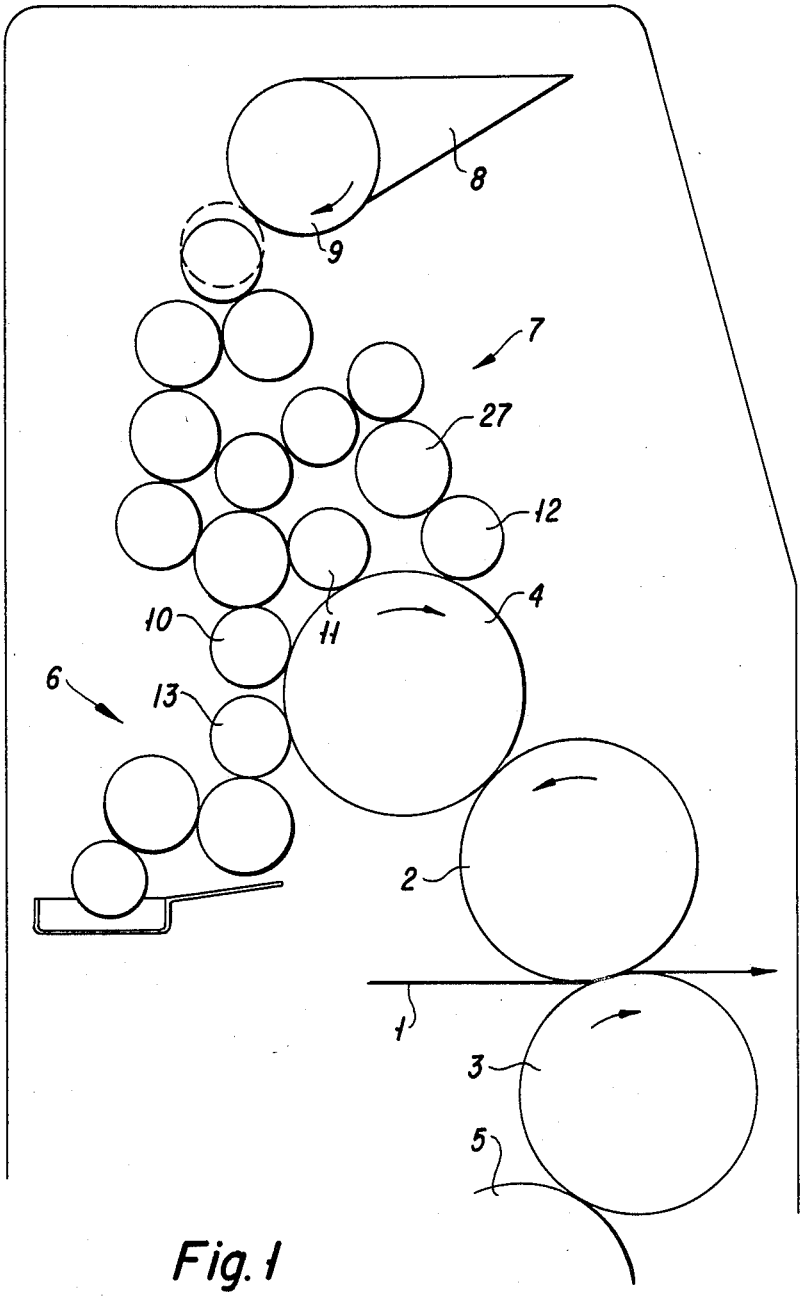

The invention relates to an inking unit for printing presses and, more particularly, to such an inking unit wherein the ink is fed in a metered fashion from an ink supply tank to the inking rollers of the inking unit due to which an ink film is applicable to a plate cylinder, via a plurality of ink form rollers respectively in contact with a distribution roller and disengageable from the plate cylinder, the last of the plurality of form rollers, as viewed in rotational direction of the plate cylinder, being constructed so as to oscillate.

German Patent No. 30 34 644 discloses an inking unit wherein four form rollers are driven by appertaining distributor rollers through the intermediary of spur gears and perform an axial movement through the intermediary of a cylinder cam disposed on the shaft of the form roller. The roller shaft driven via the spur gear should, in this regard, have a different rotational speed than that of the form rollers. This German patent also mentions that a single form roller is provided having a construction to perform oscillations, this form roller being the last form roller as viewed in direction of rotation of the plate cylinder. The purpose of the construction described in this German patent is to improve the stencilling behavior of an inking unit.

A disadvantage of the foregoing heretoforeknown construction is that it necessitates a considerable constructional expense to drive, from the distributor rollers via additional spur gear, the form rollers which are disengageable from the plate cylinder, to provide the shafts of the form rollers on both sides thereof with rotatable and swivelable bearings and to dispose cylinder cams with cam rollers within the form rollers in order to perform a lateral displacement thereof.

It is accordingly an object of the invention to provide an inking unit for printing presses which is improved in a relatively simple manner so that, with uniform inking of the plate cylinder, stencilling on the printing plate and in the printed image, respectively, is avoided.

With the foregoing and other objects in view, there is provided, in accordance with the invention, an inking unit for printing machines wherein ink is fed in a metered fashion from an ink supply tank to inking rollers of the inking unit by which an ink film is applicable to a printing plate via a plurality of ink form rollers respectively in contact with a distributor roller and disengageable from a plate cylinder, the last of the plurality of form rollers, as viewed in rotational direction of the plate cylinder, being constructed so as to oscillate, comprising a roller shaft mounted so as to be fixed against rotation in bearings on the printing machine, the oscillating form roller having a casing with an outer cylindrical surface, the form roller casing being rotatably mounted on the roller shaft and being axially displaceable on the roller shaft for performing a stroke limited at both sides by respective pairs of bushings also mounted on the roller shaft, and including a respective compression spring disposed between the bushings of the respective pairs of bushings on each side of the oscillating form roller.

In accordance with another feature of the invention, the form roller casing having the outer cylindrical surface is mounted via needle bearings with elongated inner bushings on the roller shaft, one of the bushings of each of the pairs of bushings being disposed axially inwardly with respect to the oscillating form roller, the inwardly disposed bushings, respectively, being braced by a compression spring and being mounted rotatably through the intermediary of a ball bearing in the roller casing having the outer cylindrical surface.

The differences in the thickness of the ink film on the last form roller which occur during stencilling are shifted with respect to the other form rollers due to the axial displacement of the last form roller so that no sharp contours are provided any longer and, accordingly, stencilling is no longer visible on the completed printed image. Due to the gentle and free movement of the form roller and due to the asynchronous course of movement with respect to the appertaining distributor roller via the compression springs which are provided, equalization or balancing of the ink film is improved and wear of the printing plate is avoided. In practice, a lateral movement of the form roller over a distance of a few millimeters has proved to be fully adequate.

Other features which are considered as characteristic for the invention are set forth in the appended claims.

Although the invention is illustrated and described herein as embodied in inking unit for printing presses, it is nevertheless not intended to be limited to the details shown, since various modifications and structural changes may be made therein without departing from the spirit of the invention and within the scope and range of equivalents of the claims.

Figure 2:
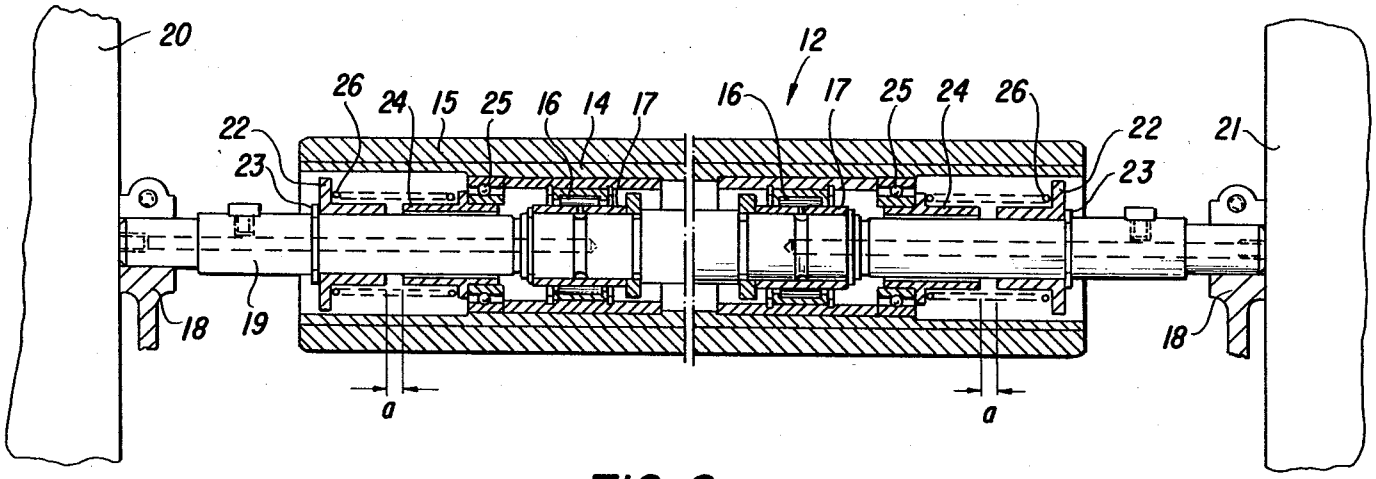

The construction and method of operation of the invention, however, together with additional objects and advantages thereof will be best understood from the following description of specific embodiments when read in connection with the accompanying drawings, in which:

FIG. 1 is a highly diagrammatic side elevational view of an inking unit including an oscillating form roller; and FIG. 2 is a fragmentary longitudinal sectional view of the oscillating form roller of FIG. 2.

Referring now to the drawing and, first, particularly to FIG. 1 thereof, there is shown in a diagrammatic side elevational view, a normal or conventional offset printing unit for printing a paper web 1 between two rubber-covered or blanket cylinders 2 and 3 each cooperating with a respective plate cylinder 4 and 5. The depicted upper half of the printing unit has a dampening unit 6 for dampening the printing plate disposed on the plate cylinder 4. Additionally illustrated is an inking unit 7 formed of an ink duct 8, a duct roller 9, several inking and distributor rollers, respectively, and form rollers or ink applicator rollers 10,11, and 12. In order to stop the printing, both the form rollers 10 to 12 as well as dampening-medium applicator rollers 13 are mounted so as to be disengageable from the plate cylinder 4. In this regard, the rubber-covered cylinders and the plate cylinders are disengaged from one another in a conventional manner, so that the outer cylindrical surfaces thereof are no longer in contact.

An oscillating form roller is shown in FIG. 2 and, as viewed in rotational direction of the plate cylinder 4 in FIG. 1, may be the last roller 12. The form roller 12 has a casing with an outer cylindrical surface 14 which is covered or blanketed by an elastic covering 15, such as of rubber, for example. The casing with the outer cylindrical surface 14 is mounted, through the intermediary of needle bearings 16 with extended or elongated inner bushings 17, rotatably and axially displaceably on a roller shaft 19 which is, in turn, mounted so as to be fixed against rotation in bearings 18. In the illustrated embodiment, the bearings 18 are provided between side frames 20 and 21 of the printing unit and serve for disengaging the form roller 12 when the printing is stopped.

Bushings 22 are fastened on the roller shaft 19 by clamping rings 23 which serve as a stop for bushings 24 which are disposed through the intermediary of ball bearings 25 on the inner surface of the roller casing having the outer cylindrical surface 14. Between both of the bushings 22 and 24, there is a spacing a of about 4 mm. when the form roller is in middle position, so that the form roller 12 can execute a full lateral stroke of about 8 mm.

On both sides of the form roller 12, compression springs 26 are provided between the bushings 22 and 24, and have a compressive force of such dimension that, during the lateral stroke of the distributor roller 27 cooperating therewith, the form roller 12 follows by the amount a, and remains in this position until the distributor roller 27 experiences a reversal of motion in the respective dead center thereof. The instant that the lateral movement of the distributor roller 27 approaches zero (0), the respective compression spring initiates the return movement of the distributor roller 12 into the initial position thereof. Thereafter, entrainment thereof to the other side occurs, until the bushings 24, 26 meet one another. Thus, an asynchronous lateral movement is executed by the form roller 12 to the distributor roller 27 which prevents stencilling without requiring any additional drive.

The foregoing is a description corresponding, in substance, to German application G 83 30 123.2, dated Oct. 19, 1983, international priority of which is being claimed for the instant application, and which is hereby made part of this application. Any material discrepancies between the foregoing specifications and the specification of the aforementioned corresponding German application are to be resolved in favor of the latter.

There are claimed:

1. An inking unit for printing machines wherein ink is fed in a metered fashion from an ink supply tank to inking rollers of the inking unit by which an ink film is applicable to a printing plate via a plurality of ink form rollers respectively in contact with a distributor roller and disengageable from a plate cylinder, the last of the plurality of form rollers, as viewed in rotational direction of the plate cylinder, being constructed so as to oscillate, comprising a roller shaft mounted so as to be fixed against rotation in bearings on the printing machine, the oscillating form roller having a casing with an outer cylindrical surface, said form roller casing being rotatably mounted on said roller shaft and being axially displaceable on said roller shaft for performing a stroke limited at both sides by respective pairs of bushings also mounted on said roller shaft, and including a respective compression spring disposed between the bushings of the respective pairs of bushings on each side of said oscillating form roller.

2. An inking unit according to claim 1 wherein said form roller casing having said outer cylindrical surface is mounted via needle bearings with elongated inner bushings on said roller shaft, one of the bushings of each of said pairs of bushings being disposed axially inwardly with respect to said oscillating form roller, said inwardly disposed bushings, respectively, being braced by a compression spring and being mounted rotatably through the intermediary of a ball bearing in the roller casing having said outer cylindrical surface.

* * * * *